US008529411B2

(12) United States Patent
DiGiovanni

(10) Patent No.: US 8,529,411 B2
(45) Date of Patent: Sep. 10, 2013

(54) FOOT AND ANKLE EXERCISE DEVICE

(75) Inventor: Craig S. DiGiovanni, Southlake, TX (US)

(73) Assignee: Medi-Dyne Healthcare Products, Ltd., Colleyville, TX (US)

( * ) Notice: Subject to any disclaimer, the term of this patent is extended or adjusted under 35 U.S.C. 154(b) by 5 days.

(21) Appl. No.: 12/536,171

(22) Filed: Aug. 5, 2009

(65) Prior Publication Data

US 2010/0035734 A1 Feb. 11, 2010

Related U.S. Application Data

(60) Provisional application No. 61/086,529, filed on Aug. 6, 2008.

(51) Int. Cl.
*A63B 21/00* (2006.01)

(52) U.S. Cl.
USPC ..... 482/79; 482/80

(58) Field of Classification Search
USPC ..... 482/79, 80, 140, 907; 36/132; 601/34, 601/27; 297/258.1
See application file for complete search history.

(56) References Cited

U.S. PATENT DOCUMENTS

| | | | | |
|---|---|---|---|---|
| 2,390,416 | A | 12/1945 | Bettmann | |
| 2,392,735 | A | 1/1946 | Hahn | |
| 2,700,832 | A * | 2/1955 | Slovinski | 36/140 |
| 3,295,847 | A | 1/1967 | Matt, Sr. | |
| 3,421,760 | A | 1/1969 | Freeman, Jr. | |
| 3,472,508 | A | 10/1969 | Baker et al. | |
| 3,613,674 | A | 10/1971 | Volz | 128/83.5 |
| 3,680,550 | A | 8/1972 | Tunstall | 128/83.5 |
| 4,206,558 | A | 6/1980 | Bivona | 36/7.5 |
| 4,446,856 | A | 5/1984 | Jordan | 128/80 R |
| 4,708,339 | A | 11/1987 | Perrine | 272/97 |
| 4,821,432 | A | 4/1989 | Reiber | 36/110 |
| 4,951,938 | A | 8/1990 | Smith, IV | 272/96 |
| 5,135,450 | A * | 8/1992 | Smith, IV | 482/80 |
| 5,186,698 | A | 2/1993 | Mason et al. | 482/79 |
| 5,197,932 | A * | 3/1993 | Smith, IV | 482/79 |
| 5,222,925 | A | 6/1993 | Maycock et al. | 482/44 |
| 5,284,465 | A | 2/1994 | Homan, Jr. | 482/148 |
| 5,518,476 | A * | 5/1996 | McLeon | 482/79 |
| 5,529,550 | A | 6/1996 | Maycock, Jr. et al. | 482/44 |
| 5,611,770 | A | 3/1997 | Tesch | 601/34 |
| 5,702,354 | A | 12/1997 | DeSpain et al. | 601/27 |
| 5,713,820 | A | 2/1998 | Carbone | 482/79 |
| 5,897,464 | A * | 4/1999 | Mcleod | 482/79 |
| 5,935,047 | A | 8/1999 | Cawley | 482/79 |
| D420,407 | S | 2/2000 | Garcia et al. | |
| 6,077,203 | A | 6/2000 | Lay | 482/79 |
| 6,409,692 | B1 | 6/2002 | Covey | 602/5 |

(Continued)

FOREIGN PATENT DOCUMENTS

FR 1533522 6/1968

OTHER PUBLICATIONS

"Prostretch"; file:///U/prostretch.htm ; www.shapeupshop.com ; pp. 2, Aug. 12, 2008.

*Primary Examiner* — Jerome W Donnelly
(74) *Attorney, Agent, or Firm* — Baker Botts L.L.P.

(57) ABSTRACT

The present invention relates to a rocker boot for stretching or strengthening muscles. The rocker boot may include a base having a arcuate surface and a footrest attached to the base. The footrest may be adjustable to provide one or more different configurations.

19 Claims, 10 Drawing Sheets

(56) References Cited

U.S. PATENT DOCUMENTS

| | | | | |
|---|---|---|---|---|
| 6,421,935 | B1 | 7/2002 | Bartlett | 36/132 |
| 6,821,235 | B1 * | 11/2004 | Johnson et al. | 482/79 |
| D505,985 | S | 6/2005 | Carbonero | D21/688 |
| 6,923,751 | B2 * | 8/2005 | Oxford | 482/146 |
| 6,971,977 | B1 * | 12/2005 | Chen | 482/140 |
| 7,011,612 | B2 | 3/2006 | Repking | 482/142 |
| 7,278,227 | B2 | 10/2007 | Masoodifar | 36/114 |
| 7,500,324 | B1 * | 3/2009 | Power et al. | 36/132 |
| 2005/0164845 | A1 * | 7/2005 | DiGiovanni | 482/79 |
| 2005/0209058 | A1 * | 9/2005 | Yu | 482/52 |
| 2005/0239611 | A1 * | 10/2005 | Commisso | 482/93 |

* cited by examiner

FOOT AND ANKLE EXERCISE DEVICE

CROSS REFERENCE TO RELATED APPLICATION

This application claims the benefit of U.S. Provisional Application No. 61/086,529 filed on Aug. 6, 2008, entitled "FOOT AND EXERCISE DEVICE" which is incorporated herein in its entirety.

FIELD OF THE INVENTION

The present invention relates to a foot and exercise device. The device may be used to stretch or strengthen muscles and tissues during exercise or physical therapy.

BACKGROUND

Exercise boots with an arcuate base may be used to stretch or exercise muscles and connective tissue in the leg, particularly the lower leg. Such boots are used by placing one's foot on the boot, them moving the boot backward and forward on the arcuate base. These boots may be used one at a time, or two may be combined to allow exercise of both legs simultaneously.

In general, the range of motion for stretching or exercising available to a user is defined by the geometry of an exercise boot. An exercise boot with an arcuate base has a potential degree of rotation defined in part by the arcuate length of the base. An exercise boot may also have one or more stretch angles defined by a foot platform.

A prior art exercise boot 1 is depicted in FIGS. 1 and 2. Rocker boot 1 includes a footrest and a base 30. The footrest of boot 1 comprises a toe rest 10 and a heel rest 20. Base 20 includes at least one arcuate rail 38. Toe rest 10 includes a front edge 12, a back edge 14, sides 16*a* and 16*b*, and a set of ridges 18. Heel rest 20 includes a front edge 22, a heel stop 24, sides 26*a* and 26*b*, and a set of ridges 28. Base 20 includes a toe hole 32, a heel hole 34, a recess 36, and at least one arcuate rail 38.

Boot 1 may be used to stretch or exercise muscles and connective tissue in the leg, particularly the lower leg. Boot 1 may be used by placing one's foot on boot 1, them moving boot 1 backward and forward on base 30, rolling along arcuate rail 38. Boot 1 may be used by itself, or joined with a second boot 1 to allow exercise of both legs simultaneously.

Boot 1 includes a potential degree of rotation defined by the geometry of boot 1, including rotation angles labeled $\theta_1$ and $\theta_2$ in FIGS. 1 and 2. In addition, the geometry of boot 1 defines a stretch angle labeled $\beta$ in FIG. 2. Angles $\theta_1$, $\theta_2$, and $\beta$ are defined and fixed at the time boot 1 is made and cannot be changed later by a user.

SUMMARY OF THE INVENTION

In accordance with teachings of the present invention, a rocker boot and method of its use and manufacture are provided. The rocker boot may include a base having a arcuate surface and a footrest attached to the base. The footrest may include a plurality of connectors configured to receive an attachment configured to adjust a stretch angle provided by the rocker boot.

In accordance with teachings of the present invention, a platform for use with a rocker boot is provided. The platform may include a toe rest, a bracket configured to releasably attach the platform to the rocker boot, and a plurality of connectors configured to receive an attachment configured to a stretch angle of the rocker boot.

In accordance with teachings of the present invention, a method of using a rocker boot including a base having a arcuate surface and a footrest attached to the base is provided. The method may include selecting an attachment configured to adjust a stretch angle of the rocker boot, connecting the attachment to one or more of a plurality of connectors associated with the footrest of the rocker boot, placing a foot upon the footrest, and using the foot to rotate the rocker boot.

Rocker boots of the present invention may be made of a variety of materials, including metal and plastic, which may be formed using a variety of techniques, including injection molding, casting and machining. Rocker boots may include more than one type of material, which may be bonded to one another.

Two rocker boots may be attached together, for example with a bar, to allow exercise of both feet and legs simultaneously.

BRIEF DESCRIPTION OF THE DRAWINGS

A more complete and thorough understanding of the present invention and advantages thereof may be acquired by referring to the following description taken in conjunction with the accompanying drawings, in which like reference numbers indicate like features, and wherein.

DETAILED DESCRIPTION

Specific embodiments of the invention and its advantages are best understood by reference to FIGS. 3-8B wherein like numbers refer to same and like parts. As previously mentioned rocker boots with an arcuate base may be used to stretch or exercise muscles and connective tissue in the leg, particularly the lower leg. The range of motion available to a user may affect the utility and/or effectiveness of the exercise.

It is sometimes desirable to limit the degree of rotation for some users in order to allow a more defined workout, to add stability, or for other reasons. In other cases, it may be desirable to extend the degree of rotation in order to provide a deeper stretch or additional range of motion. In other cases, it may be desirable to increase or decrease one or more parameters of rocker boot 2 to provide a shallower or deeper stretch of the leg and/or legs.

In some cases, the users of an rocker boot such as those depicted in FIGS. 3-8B may prefer to vary the parameters of rocker boot 2 to vary the exercise. For example, a user may wish to vary the stretch angle, $\beta$, to change the angle between the toe rest and the heel rest. As another example, a user may wish to vary rotation angles, $\theta_1$ and $\theta_2$. Various features, components, and/or devices of boot 2 may allow a user to adjust these angles and/or other parameters and/or characteristics of boot 2.

Figure 1:
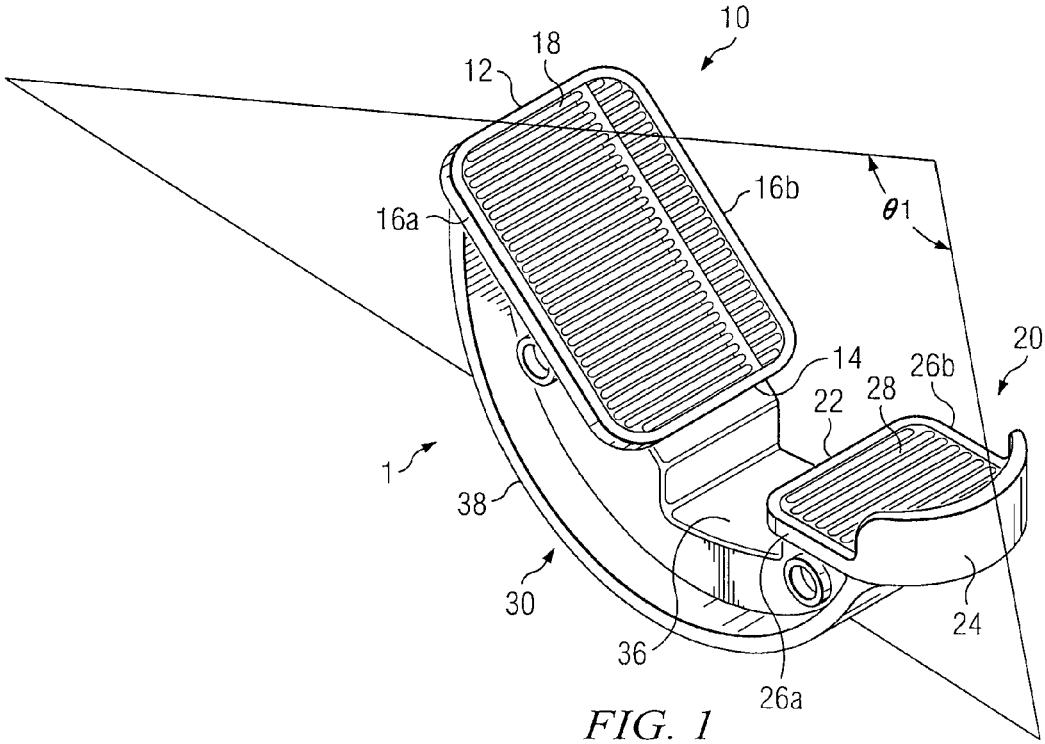
FIG. 1 (PRIOR ART)
FIG. 1 illustrates an isometric view of a prior art rocker boot.
Figure 2:
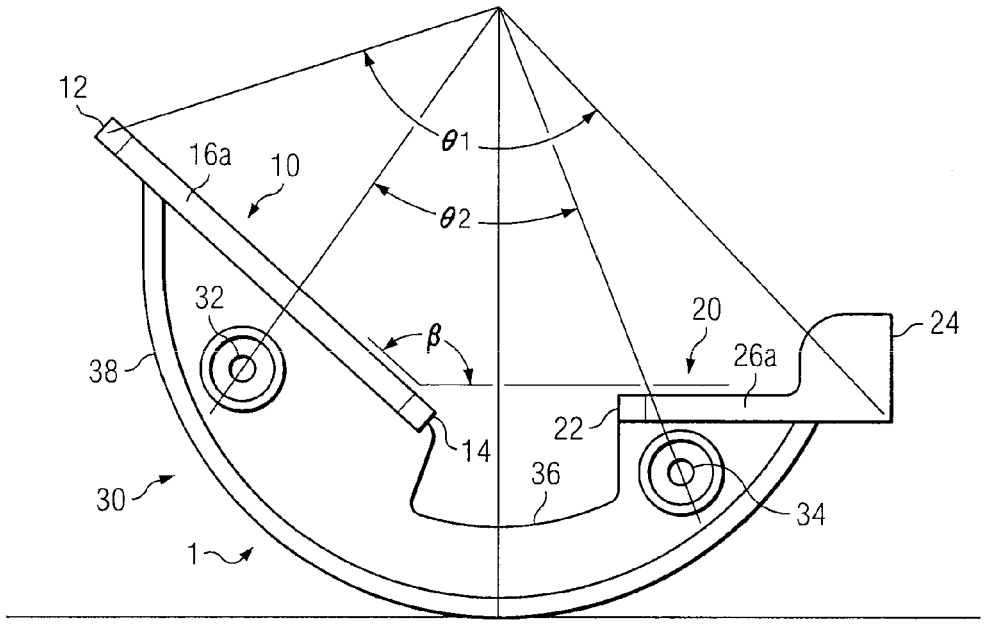
FIG. 2 (PRIOR ART)
FIG. 2 illustrates a side view of a prior art rocker boot.
Figure 3:
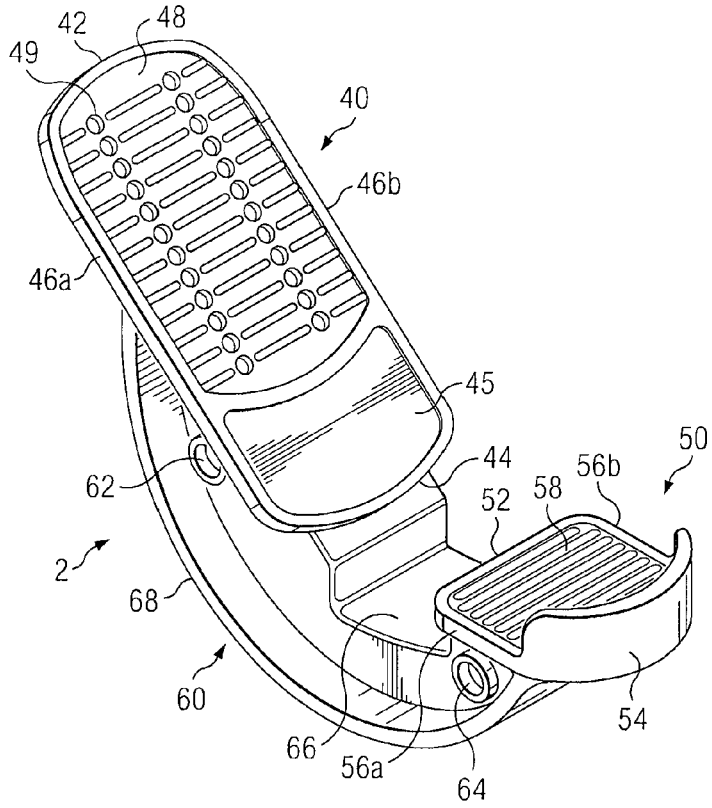
FIG. 3 illustrates an isometric view of a rocker boot, according to an embodiment of the present disclosure.
Figure 4:
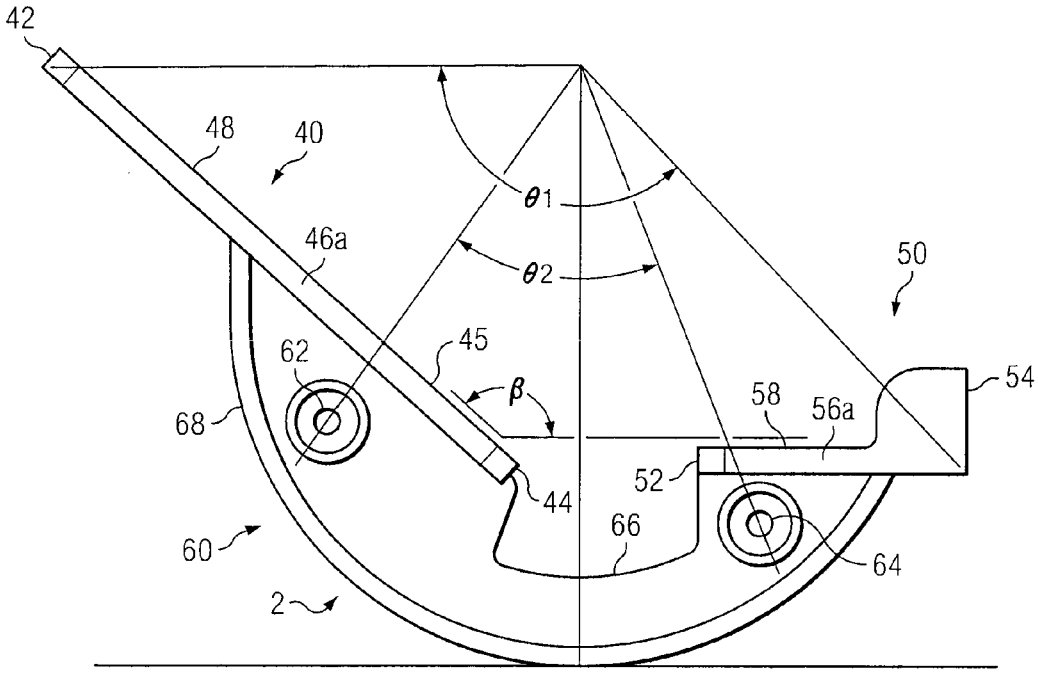
FIG. 4 illustrates a side view of a rocker boot, according to an embodiment of the present disclosure.

FIGS. 3 and 4 illustrate a rocker boot 2, according to an embodiment of the present disclosure. As shown in FIGS. 3 and 4, rocker boot 2 may include a toe rest 40, a heel rest 50, and a base 60.

Toe rest 40 may include any feature or component of rocker boot 2 configured to provide a rest for the toes and/or the ball of the foot of a user. In some embodiments, toe rest 40 may include an extended flat plate. In such embodiments, toe rest 40 may include an outer edge 42, an inner edge 44, plate 45, and sides 46*a* and 46*b*. In some embodiments, toe rest 40 may include ribs 48 and connectors 49.

Outer edge 42, inner edge 44, and sides 46*a* and 46*b* may define the perimeter of toe rest 40. Outer edge 42, inner edge 44, and sides 46*a* and 46*b* may include ridges, lips, and/or other features configured to facilitate use for stretching or exercise. Ribs 48 may include any component and/or feature of toe rest 40 configured to provide an interface between rocker boot 2 and a user's foot and/or shoe.

Connectors 49 may include any feature and/or component of toe rest 40 configured to connect accessory devices and/or additional components to rocker boot 2. For example, connectors 49 may include a set of matched holes configured to receive pegs on an accessory device. As another example, connectors 49 may include pegs configured to be received in holes on an accessory device. Persons having ordinary skill in the art will be able to apply the teachings of the present disclosure using a wide variety of connectors known in the art.

Heel rest 50 may include any feature or component of rocker boot 2 configured to provide a rest for the heel of a user. In some embodiments, heel rest 50 may include an extended flat plate. In such embodiments, heel rest may include an inner edge 52, a heel stop 54, sides 56*a* and 56*b*, and ribs 58.

Inner edge 52, heel stop 54, and sides 56*a* and 56*b* may define the perimeter of heel rest 50. Inner edge 52, heel stop 54, and sides 56*a* and 56*b* may include ridges, lips, and/or other features configured to facilitate use for stretching or exercise. Ribs 58 may include any component and/or feature of heel rest 50 configured to provide an interface between rocker boot 2 and a user's foot and/or shoe.

Arcuate base 60 may be any curvilinear shape (e.g., a semi-circular or ellipsoid shape). The shape of base 60 may be chosen to affect the operation of rocker boot 2 (e.g., exercise difficulty and stability). Base 60 may include a single arcuate rail 68 or multiple arcuate rails.

Rocker boot 2 may include one or more holes configured to fit a connector (e.g., a bar) to secure two rocker boots 2 together, thus allowing simultaneous use. Two such holes 62 and 64 are depicted in FIGS. 3 and 4. For example, two rocker boots 2 may be connected by placing one end of a bar in hole 62 on a first rocker boot 2 then placing the other end of the bar in hole 62 of a second rocker boot 2. Other mechanisms may also be used to secure two boots for simultaneous rocking.

All or selected parts of rocker boot 2 may be made of any suitable material, such as plastic, particularly injection-molded plastic, metal, particularly machined or cast metal, or combinations thereof. For example, metal parts may be made of cast aluminum. Rocker boot 2 may actually represent a continuous piece of material, or the individually numbered parts may be separately formed and then attached to one another. For example, toe rest 40, heel rest 50, and base 60 may all be made from a single piece of injection-molded plastic. Other suitable combinations of metal, plastic and other materials as well as suitable production designs will be apparent to one of skill in the art.

Toe rest 40 and heel rest 50 may be separate as shown, or they may form a continuous footrest (not shown). Further, rests 40 and 50 may individually or both have ridges (48 and 58) to aid in securing a foot when the rocker boot is in use. Such ridges may be formed from the material of the footrests themselves, or they may be supplied as a separate component, which may be made from a different material (e.g., adhesive rubber pads).

Rocker boot 2 may be used by placing a foot on toe rest 40 and heel rest 50, then using the foot to rotate the rocker boot in one direction along the arcuate surface of base 60. The foot may then used to rotate rocker boot 2 in the opposite direction along the arcuate surface of base 20. Using a foot to rotate rocker boot 2 stretches and/or strengthens tissues in the foot and attached leg, particularly the lower leg. When rocker boot 2 is rotated in a forward direction, plantarflexion occurs, thereby stretching and/or strengthening the anterior flexors such as the anterior tibialis and extensor digitorum longus, and potentially the plantar fascia. When rocker boot 2 is rotated in a backward direction, dorsiflexion occurs, thereby stretching and/or strengthening the plantar flexors such as the gastrocnemius and soleus calf muscles, the achilles tendon and the plantar fascia.

If two rocker boots 2 are connected as described above, they may be operated by both feet and legs simultaneously. In such event, both feet may be used to rotate both rocker boots in one direction at substantially the same time. Both feet may then be used to rotate rocker boots 2 in the opposite direction.

Figure 5A:
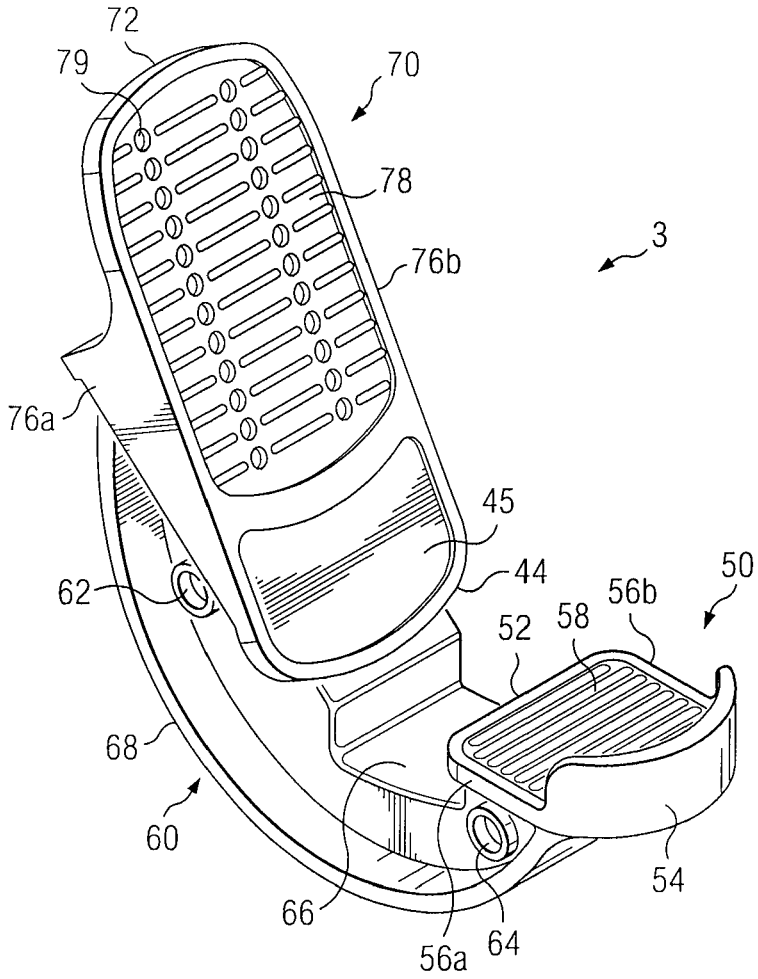
FIGS. 5A-5C illustrate a rocker boot with an adjustment platform according to an embodiment of the present disclosure.

FIG. 5A illustrates an isometric view of a rocker boot 3 including a platform 70 according to an embodiment of the present disclosure. Platform 70 may include any component, device, and/or feature of rocker boot 3 configured to replace and/or enhance toe rest 40. For example, platform 70 may include a removable unit configured to slide onto, snap onto, and/or otherwise connect toe rest 40.

Platform 70 may include outer edge 72, inner edge 74, plate 75, and sides 76*a* and 76*b*. Platform 70 may be formed in any suitable process and of any suitable material (e.g., those discussed in relation to rocker boot 2). Platform 70 may be configured as a permanent replacement for toe rest 40 and/or may be one of a set of replaceable attachments configured to vary the geometry of rocker boot 3.

As discussed in relation to FIGS. 3 and 4, platform 70 may include any features appropriate for toe rest 40. For example, platform 70 may include ridges 78 and connectors 79. Ridges 78 may include any component and/or feature of platform 70 configured to enhance the interaction between rocker boot 3 and a user's foot and/or shoe (e.g., to increase friction, stability, comfort, etc.).

Figure 6A:
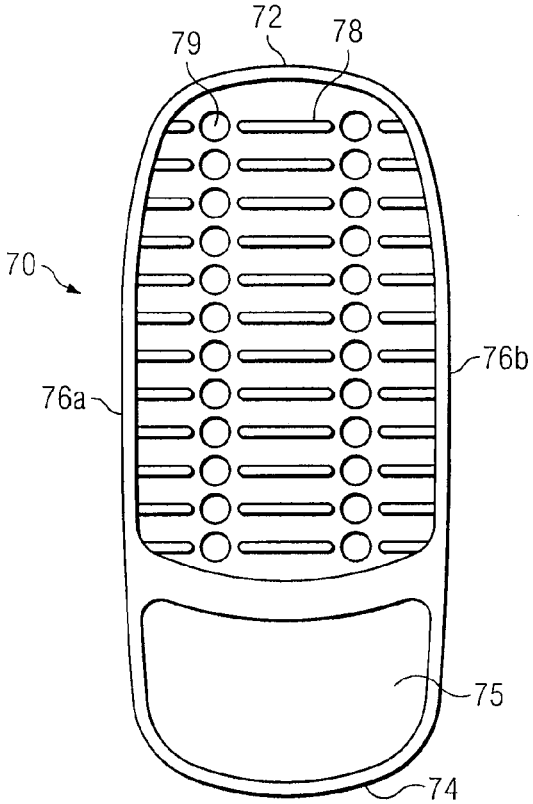
FIGS. 6A-6C illustrate multiple views of a platform for use with a rocker boot according to an embodiment of the present disclosure.
Figure 6C:
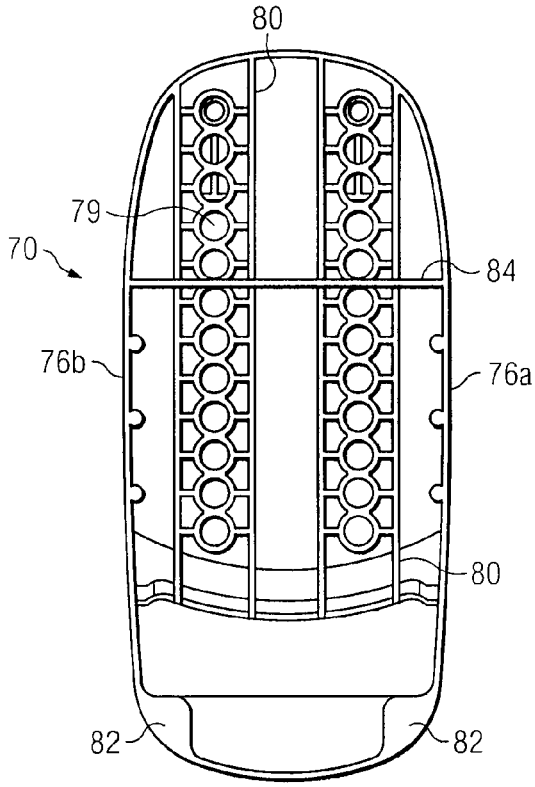
Figure 6B:
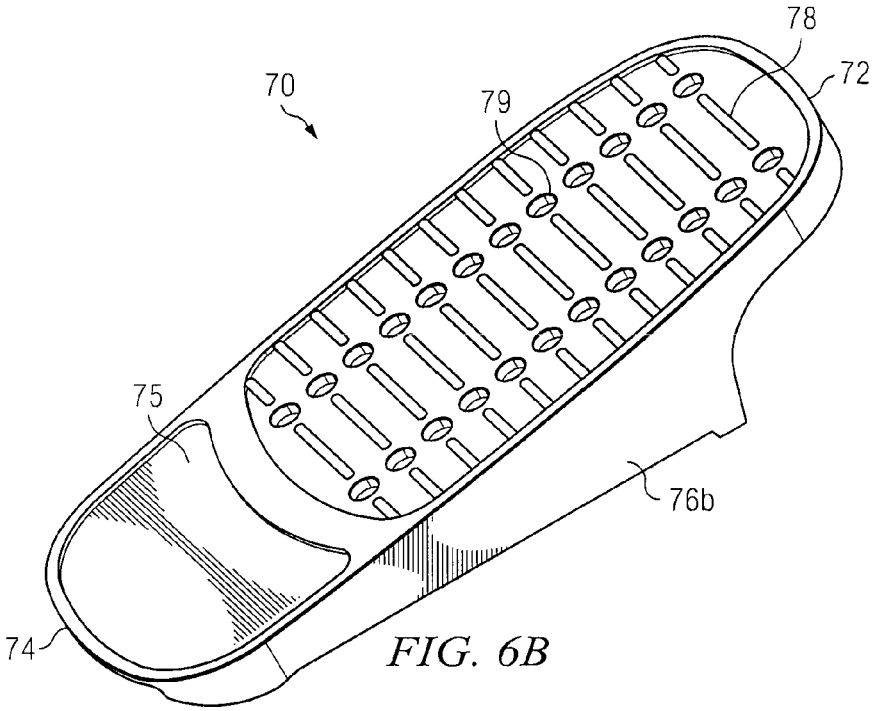

Connectors 79 may include any feature, component, and/or device of platform 70 configured to releasably attach an accessory device to rocker boot 3. For example, connectors 79 may include a set of matched holes (as shown in FIGS. 6A-6C). In other embodiments, connectors 79 may include brackets, snaps, posts, and/or any other appropriate connector for releasably attaching one or more accessory pieces to rocker boot 3.

Figure 5B:
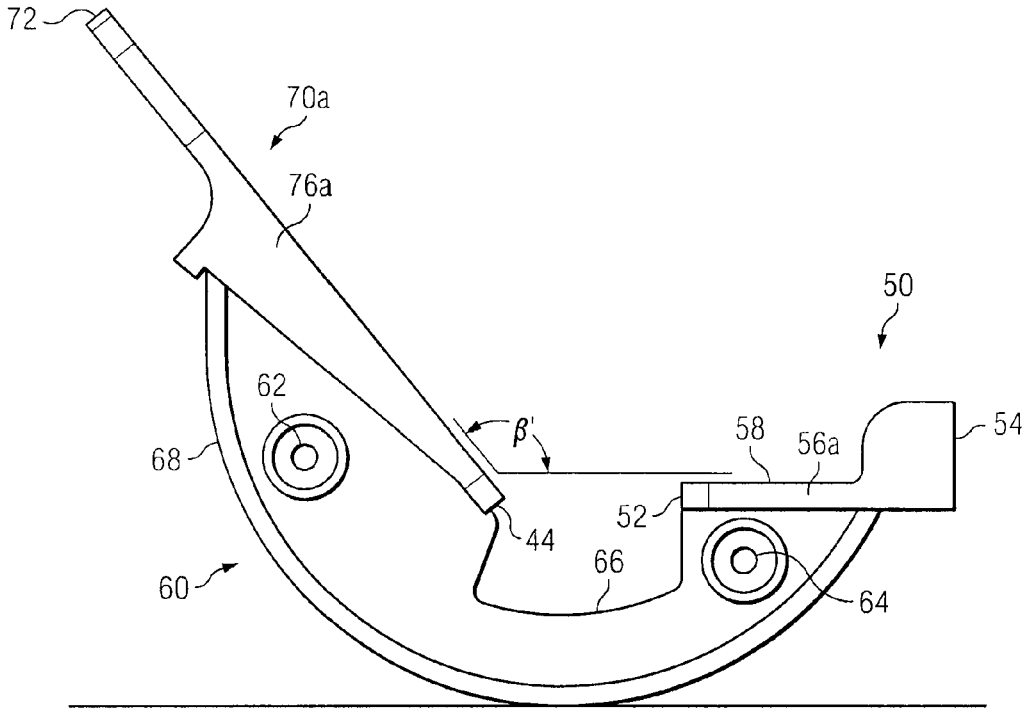
Figure 5C:
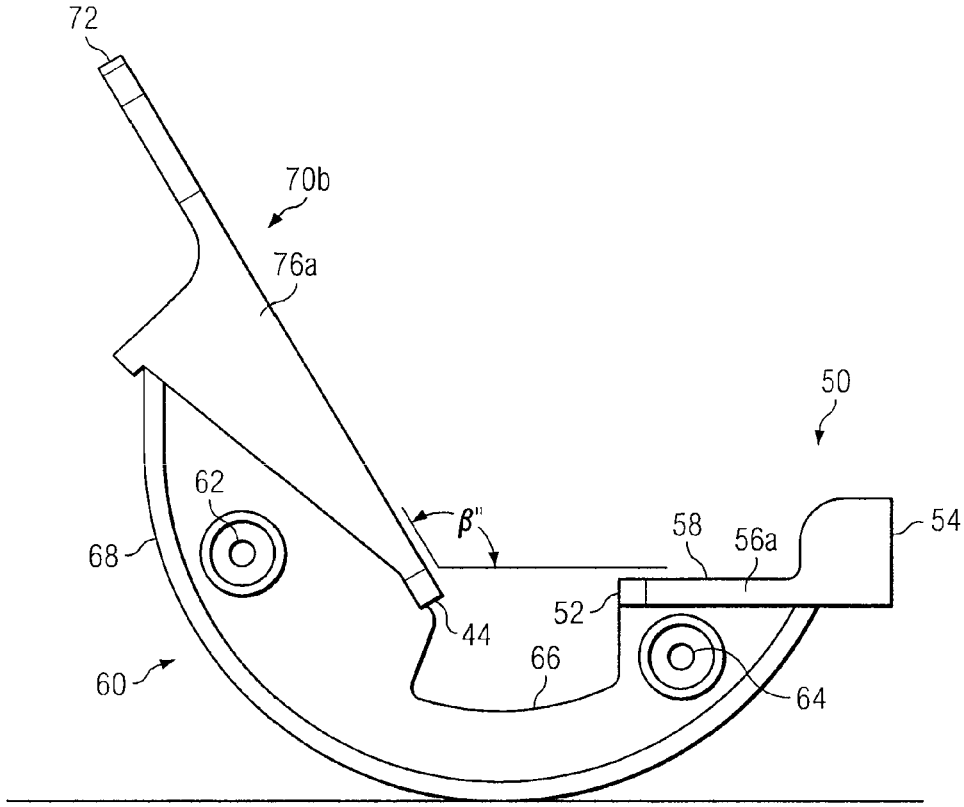

FIGS. 5B and 5C show side views of rocker boot 3 including additional platforms 70*b* and 70*c*. As shown in these FIGURES, platforms 70*b* and 70*c* may allow a user to change the stretch angle of rocker boot 3. As shown in FIG. 5B, stretch angle β' provided by platform 70*b* may be smaller than the original stretch angle β provided by rocker boot 3. As shown in FIG. 5C, stretch angle β" provided by platform 70*c* may be smaller than the original stretch angle β provided by rocker boot 3 and smaller than the stretch angle β' provided by platform 70*b*.

FIGS. 6A-6C illustrate multiple views of platform 70 for use with rocker boot 3 according to an embodiment of the present disclosure. FIG. 6A shows a top view of platform 70. Platform 70 may include any features and/or components appropriate for toe rest 40 as discussed with relation to FIG. 3.

FIG. 6B shows an isometric view of platform 70. The geometry of sides 76*a* and 76*b* may include any shapes and/or features appropriate for controlling the geometry of rocker boot 3. For example, as discussed with relation to FIGS. 5A-5C, the shape of sides 76*a* and 76*b* may control the stretch angle β provided by rocker boot 3.

FIG. 6C shows a bottom view of platform 70. Platform 70 may include braces 80, and/or brackets 82. Braces 80 may include any features, components, and/or devices configured to provide structure and/or strength to platform 70. Brackets 82 may include any features, components, and/or devices configured to attach platform 70 to toe rest 40 of rocker boot 3. Platform 70 may be configured to attach permanently to rocker boot 3 or to releasably attach so it may be used as desired. For example, brackets 82 may include a sliding connection with physical detents configured to snap onto toe rest 40.

Figures 7A, 7B, 7C:
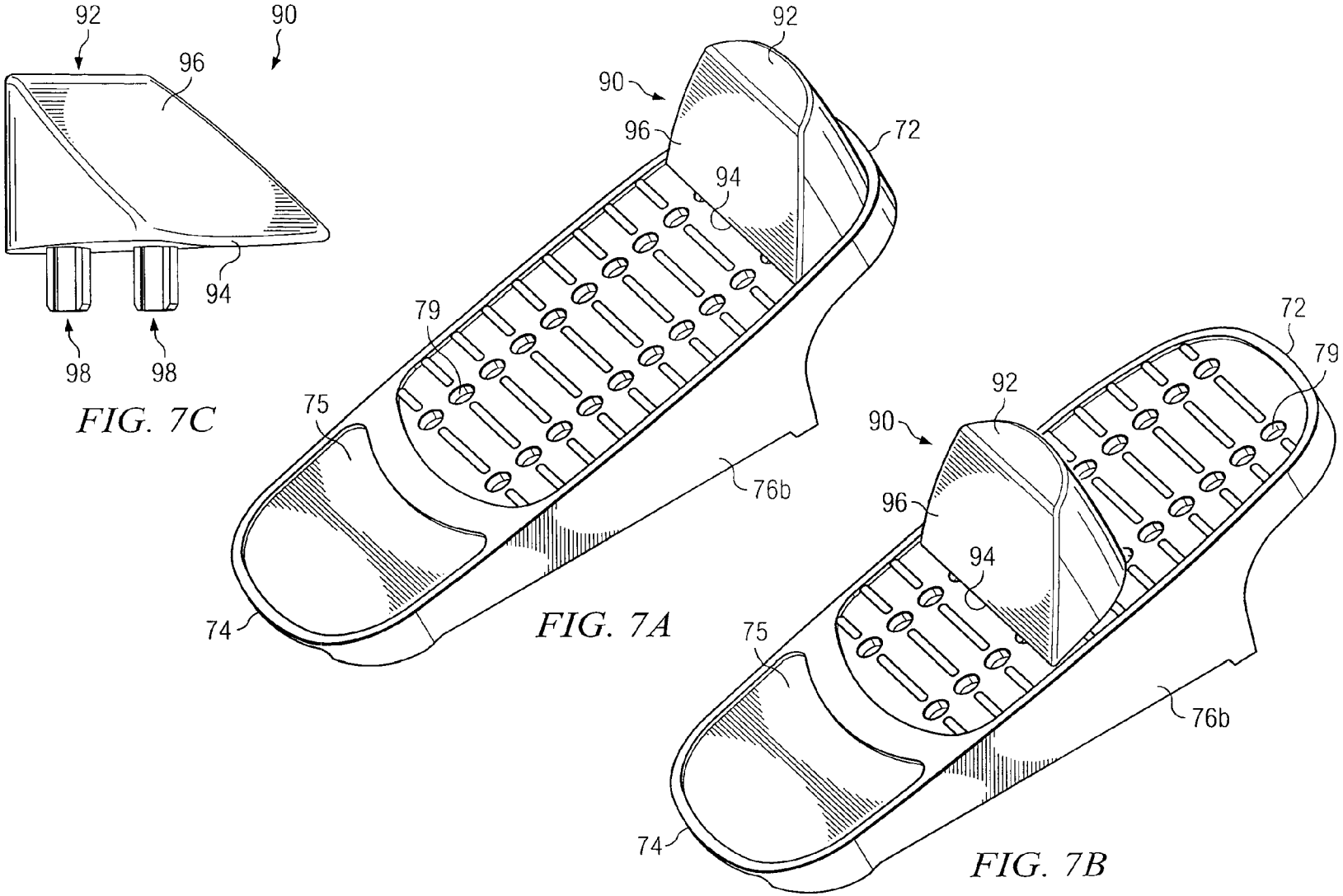
FIGS. 7A and 7B illustrate isometric views of a platform for use with a rocker boot including an optional attachment according to an embodiment of the present disclosure.
FIG. 7C shows an isometric view of the optional attachment shown in FIGS. 7A and 7B.

FIGS. 7A and 7B illustrate isometric views of platform 70 for use with rocker boot 3 including an optional attachment 90 according to an embodiment of the present disclosure. As shown in FIGS. 7A and 7B, connectors 79 of platform 70 may be configured to receive posts associated with attachment 90. The array of connectors 79 along platform 70 may define the range of attachment points for attachment 90 along platform 70. One example of an attachment 90 for use with platform 70 includes a toe wedge shown in FIGS. 7A and 7B.

Attachment 90 may include outer edge 92, inner edge 94, and/or face 96. Outer edge 92 may include any shape or feature of attachment 90 configured to mate appropriately with platform 70. Inner edge 94 my include any shape or feature of attachment 90 configured to mate appropriately with platform 70 and/or interact with the foot and/or shoe of a user. Face 96 may include any component and/or feature of attachment 90 configured to interact with the foot and/or shoe of a user (e.g., a contoured surface, a flat plane, a ridged plane, etc.).

Embodiments of attachment 90 including a toe wedge may be used to vary the contour of platform 70. In contrast to platform 70 alone, a toe wedge may be configured to allow a user to apply an additional or deeper stretch to his or her toes. In some embodiments, a toe wedge may provide additional stability when rocker boot 3 is rotated along arcuate base 60 toward the toe rest 40. As shown in FIGS. 7A and 7B, toe wedge may be located at any of several locations along platform 70 as selected by a user.

FIG. 7C illustrates an isometric view of an attachment 90 that includes a toe wedge as discussed in relation to FIGS. 7A and 7B. Attachment 90 may include connectors as previously discussed, configured to mate with platform 70. In the example embodiment shown, the connectors include pegs 98 configured to connect attachment 90 to holes 79 in platform 70. Attachment 90 may also be used with rocker boot 2 as shown in FIGS. 8A and 8B.

Figure 8A:
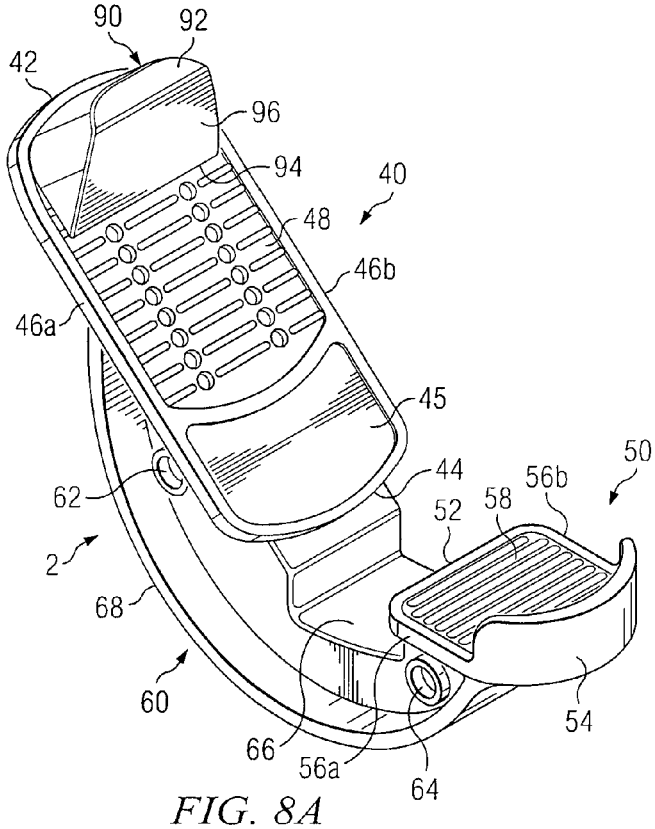
FIGS. 8A and 8B illustrate isometric views of a rocker boot including an optional attachment according to an embodiment of the present disclosure.
Figure 8B:
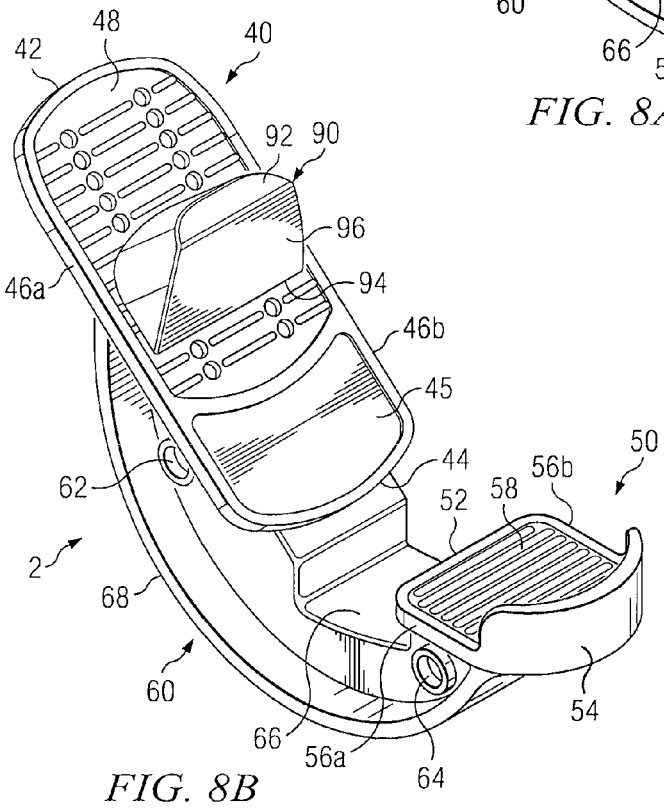

FIGS. 8A and 8B illustrate isometric views of rocker boot 2 including optional attachment 90 according to an embodiment of the present disclosure. Attachment 90 may interact with connectors 49 of rocker boot 2 in a similar manner as connectors 79 of platform 70. One embodiment of attachment 90 may include a toe wedge as shown in FIGS. 8A and 8B.

Figure 9A:
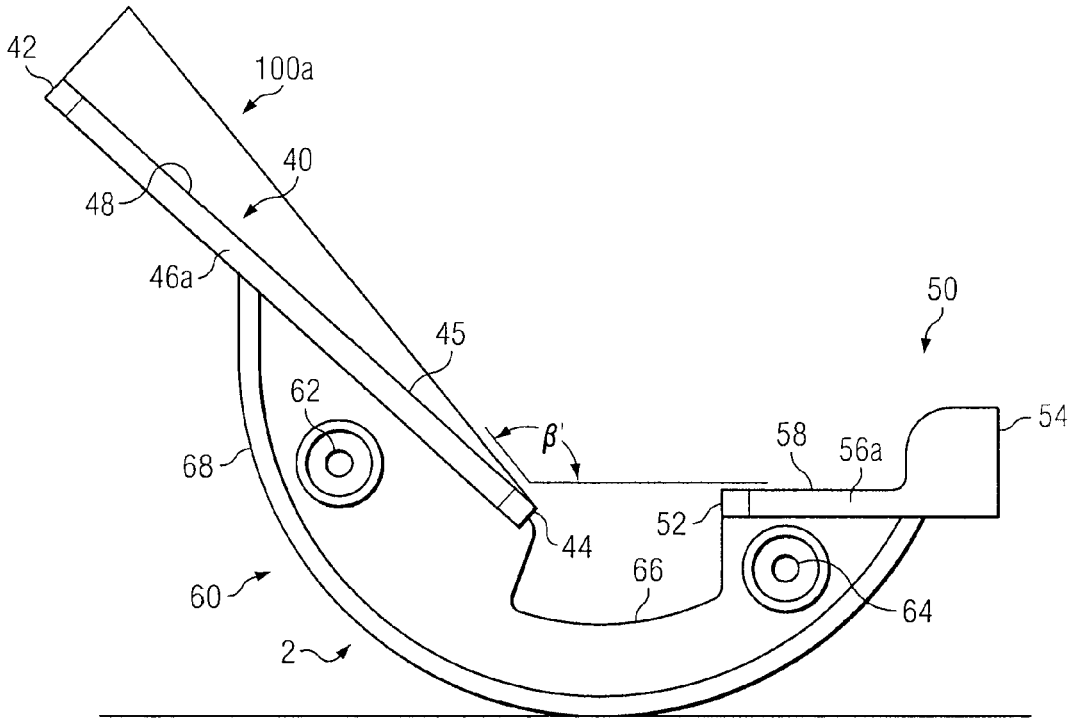
FIGS. 9A and 9B illustrate side views of a rocker boot including an optional attachment according to an embodiment of the present disclosure.
Figure 9B:
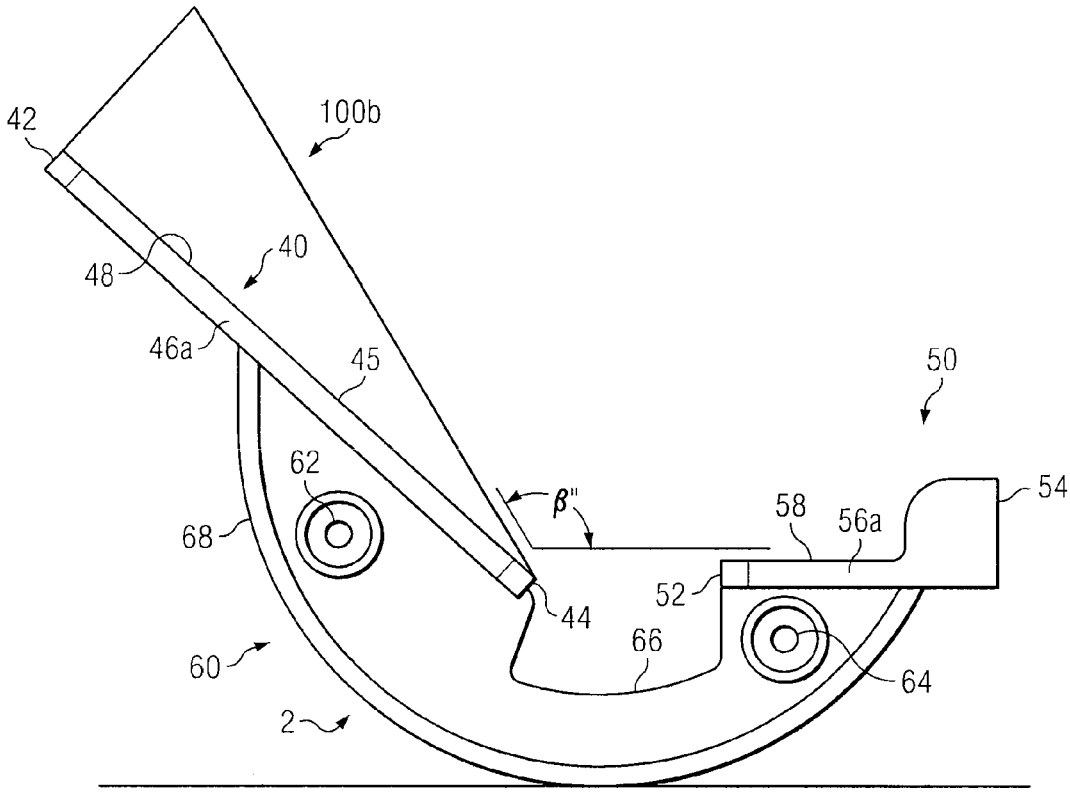

FIGS. 9A and 9B illustrate side views of rocker boot 2 including optional attachments 100*a* and 100*b* according to an embodiment of the present disclosure. As shown in FIGS. 9A and 9B, attachments 100*a* and 100*b* may provide a user with multiple stretch angles β (e.g., β' and β").

Figure 10:
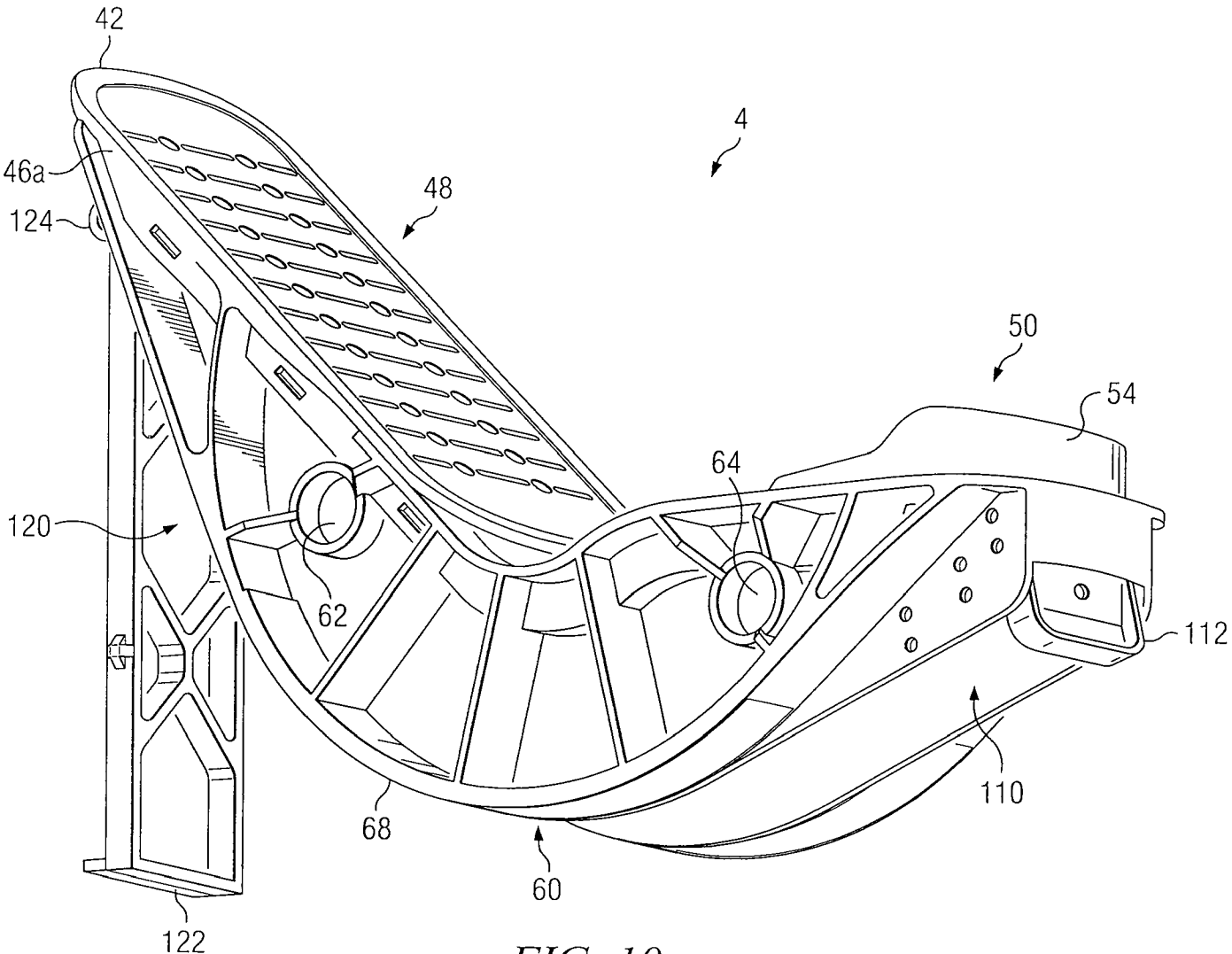
FIG. 10 illustrates an isometric view of a rocker boot including another example adjustable footrest according to an embodiment of the present disclosure.

FIG. 10 illustrates an isometric view of a rocker boot 4 including another example adjustable footrest according to an embodiment of the present disclosure. As shown in FIG. 10, rocker boot 4 may include an adjustable heel rest 50. Heel rest 50 may be moved closer to toe rest 40 or farther away. In such an embodiment, the adjustment between toe rest 40 and heel rest 50 may accommodate multiple users with feet of different lengths. In addition, an adjustable heel rest 50 may provide limitations on the rotation angle of rocker boot 4.

In another embodiment, rocker boot 4 may include one or more optional attachments configured to partially and/or completely restrict the full range of motion of rocker boot 4. For example, a heel extension 110 may restrict the rotation of rocker boot 4 so that the user's heel will not approach the floor. As another example, a toe stop 120 may restrict the rotation of rocker boot 4 so that the user's toes will not approach the floor. In combination, heel extension and toe stop 120 may substantially eliminate rotation of rocker boot 4.

Heel extension 110 may include one or more features configured to allow a user to select more than one angle for rocker boot 4. For example, FIG. 10 shows an extended lever 112 that may reduce the allowable degree of rotation beyond the limits imposed by heel extension 110. In another example, heel extension 110 may be removable. As described with relation to attachment 50 or platform 70, heel extension 110 may be provided with several alternative angles. In such embodiments, the collection of heel extensions 110 may allow a user or therapist to select among several rotation angles as appropriate for any given user.

Toe stop 120 may include any features, components, and/or devices configured to allow selective connection to rocker boot 4. For example, toe stop 120 may include foot 122 and interface 124. Foot 122 may be configured to provide a firm and stable platform for rocker boot 4. Interface 124 may be configured to interact with holes and/or other connection schemes described in relation to the proceeding figures.

Figure 11:
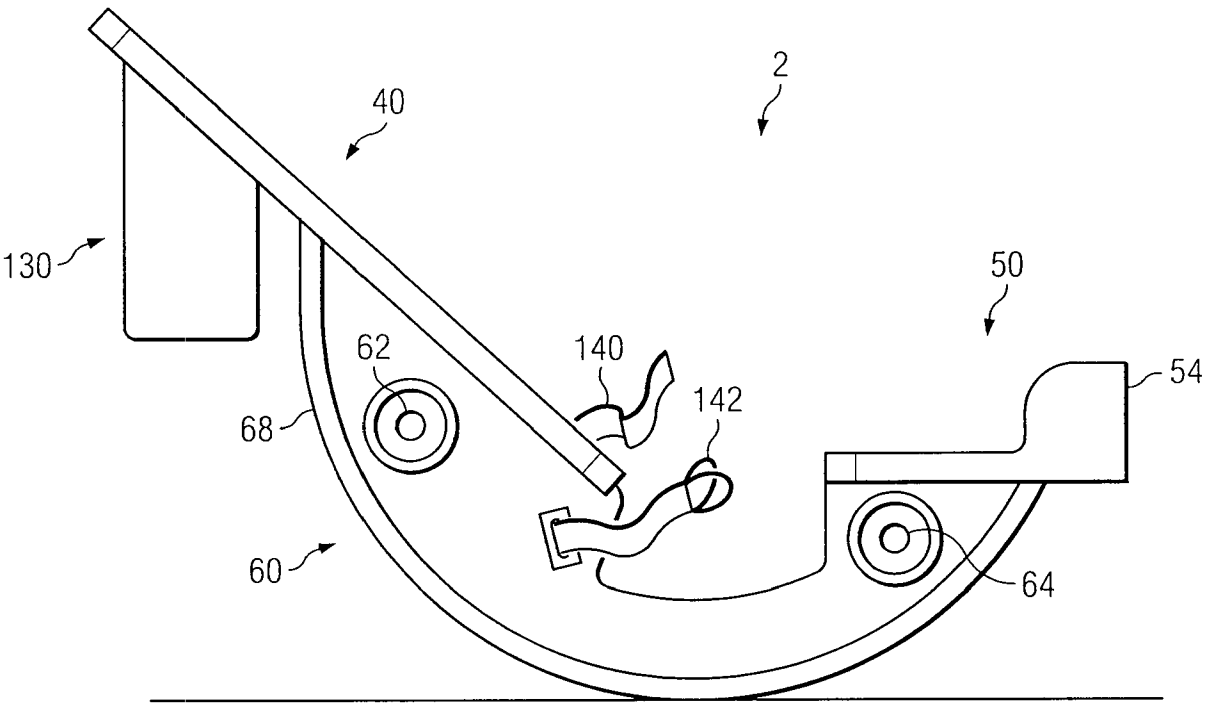
FIG. 11 illustrates a side view of a rocker boot including another example optional attachment according to an embodiment of the present disclosure.

FIG. 11 illustrates a side view of a rocker boot including another example optional attachment, weight 130, according to an embodiment of the present disclosure. Weight 130 may include one or more physical masses configured to attach to rocker boot 2. Weight 130 may attach to toe platform 40 and/or any other appropriate part of rocker boot 2. The use of weight 130 may provide increased strengthening benefit to a user.

In one embodiment, weight 130 may include one or more bottles and/or other containers. These containers may be selectively filled with water, sand, and/or another material to provide additional weight for use but allow minimal weight for packaging and/or transportation. Some embodiments including weight 130 may also include a foot strap 140.

Foot strap 140 may include any component, feature, and/or device configured to hold a user's foot to rocker boot 2. As weight 130 increases in mass, securing the user's foot to rocker boot 2 may become more important. Foot strap 140 may include a buckle 142, another device, and/or component operable to secure foot strap 140 around a user's foot.

Rocker boots 2 may be used in physical therapy or rehabilitation programs. More specifically, rocker boots 2 may be used to stretch and strengthen the tissues described above following a surgical procedure on one or more of such tissues. Rocker boots 2 may also be employed in a regular exercise program. For example, they may be employed as part of a stretching routine before rigorous leg exercise, or they may be used to maintain flexibility in the elderly.

The present disclosure teaches one to adjust one or more parameters of rocker boot 2. This function may provide added stability to an exercise regimen. It may also allow selecting the difficulty or stress of exercise using rocker boot 2. Adjustments to control the degree of rotation, stretch angle, or other geometric parameters in many embodiments may be made by most individuals without the need for specialized tools. In selected embodiments no tools are normally required. Furthermore, rocker boots 2 may be made at lower cost than many other rotating rocker boots with a limited degree of rotation.

Although the present invention and its advantages have been described in detail, it should be understood that various changes, substitutions and alternations can be made herein without departing from the spirit and scope of the invention as defined by the following claims.

The invention claimed is:

1. A rocker boot comprising:
a base having an arcuate surface; and
a footrest attached to the base, the footrest including a planar toe rest and a planar heel rest;
a stretch angle defined between the plane of the toe rest and the plane of the heel rest, the stretch angle more than 90 degrees and less than 180 degrees;
wherein:
the footrest is adjustable to provide two or more different stretch angles;
the footrest is configured to rock along the arcuate surface; and
the footrest is configured to maintain a constant angle for the stretch angle while rocking along the arcuate surface.

2. A rocker boot according to claim 1, further comprising one or more attachments configured to provide resistance to rotation of the rocker boot along the arcuate surface.

3. A rocker boot according to claim 1, wherein the footrest includes a plurality of connectors configured to receive an attachment configured to adjust the stretch angle provided by the rocker boot.

4. A rocker boot according to claim 1, further comprising:
a strap configured to hold a user's foot against the footrest; and
one or more weights configured to attach to the toe rest to provide resistance to rotation of the rocker boot along the arcuate surface.

5. A rocker boot according to claim 1, further comprising a plurality of accessories operable to adjust a rotation angle provided by the rocker boot.

6. A rocker boot according to claim 1, further comprising a plurality of heel extensions configured to attach to the rocker boot to adjust the rotation angle provided by the rocker boot.

7. A rocker boot according to claim 1, wherein the toe rest includes a platform removably attached to the rocker boot.

8. A rocker boot according to claim 1, further comprising a plurality of connectors configured to receive an attachment configured to adjust the stretch angle provided by the rocker boot, wherein the plurality of connectors includes a set of holes.

9. A rocker boot according to claim 1, further comprising a plurality of connectors configured to receive an attachment configured to adjust the stretch angle provided by the rocker boot, wherein the plurality of connectors includes a set of holes disposed in pairs on the foot rest.

10. A rocker boot according to claim 1, further comprising a toe wedge configured to mate with the foot rest.

11. A rocker boot according to claim 1, further comprising:
a set of holes disposed in pairs on the foot rest; and
a toe wedge configured to mate with one or more of the set of holes.

12. A rocker boot according to claim 1, wherein the position of the heel rest relative to the toe rest is adjustable.

13. A platform for use with a rocker boot, the platform comprising:
a toe rest;
a bracket configured to releasably attach the platform to the rocker boot; and
a plurality of connectors configured to receive an attachment configured to adjust a stretch angle of the rocker boot, the stretch angle defined between a plane of the toe rest and a plane of the heel rest;
wherein the plurality of connectors includes a set of holes, the set of holes disposed in pairs on a foot surface of the toe rest.

14. A platform according to claim 13, further comprising one or more accessories operable to adjust a rotation angle of the rocker boot.

15. A platform according to claim 13, wherein the plurality of connectors includes a set of holes.

16. A platform according to claim 13, wherein the plurality of connectors includes a set of holes, the set of holes disposed in pairs on a foot surface of the toe rest.

17. A method of using a rocker boot including a base having an arcuate surface and a footrest attached to the base, wherein the footrest includes a toe rest and a heel rest, the method comprising:
selecting an attachment configured to adjust a stretch angle of the rocker boot, the stretch angle defined as the angle between the surface of the toe rest and the surface of the heel rest;
connecting the attachment to one or more of a plurality of connectors associated with the footrest of the rocker boot;
placing a foot upon the footrest; and
using the foot to rotate the rocker boot.

18. A method according to claim 17, further comprising stretching or strengthening a tissue in the foot or a leg attached to the foot.

19. A platform for use with a rocker boot, the platform comprising:
a toe rest;
a bracket configured to releasably attach the platform to the rocker boot;
a plurality of connectors configured to receive an attachment configured to adjust a stretch angle of the rocker boot, the stretch angle defined between a plane of the toe rest and a plane of the heel rest; and a toe wedge configured to mate with one or more of the plurality of connectors.

* * * * *